US005967555A

United States Patent [19]

Samelian

[11] Patent Number: 5,967,555

[45] Date of Patent: Oct. 19, 1999

[54] REMOVABLE BINDING SYSTEM

[76] Inventor: John K. Samelian, 920 Rae Ct., Mendota Heights, Minn. 55118

[21] Appl. No.: 08/759,978

[22] Filed: Dec. 3, 1996

Related U.S. Application Data

[63] Continuation-in-part of application No. 08/440,097, May 12, 1995, abandoned.

[51] Int. Cl.[6] ..... B42F 3/00

[52] U.S. Cl. ..... 281/21.1; 402/8; 402/60; 402/500; 462/71; 462/75

[58] Field of Search ..... 281/21.1; 283/2, 283/63.1; 402/80 R, 500, 79, 8, 60; 462/12, 71, 72, 75

[56] References Cited

U.S. PATENT DOCUMENTS

| | | | |
|---|---|---|---|
| 4,153,276 | 5/1979 | Ohlsson | 281/21.1 |
| 5,050,909 | 9/1991 | Mertens et al. | 283/81 |
| 5,153,041 | 10/1992 | Clements | 283/63.1 |
| 5,336,541 | 8/1994 | Kobayashi | 283/81 |
| 5,366,776 | 11/1994 | Mertens | 283/36 |
| 5,437,476 | 8/1995 | Hutchinson | 281/21.1 |
| 5,727,817 | 3/1998 | Kraige | 281/21.1 |

*Primary Examiner*—Frances Han
*Attorney, Agent, or Firm*—Jacobson & Johnson

[57] ABSTRACT

A binding system for temporarily holding a plurality of individual sheets in a book-like manner with the system having a plurality of individual tabs, each of the tabs having a binding edge, a separation edge, a first surface and a second surface with a flexible binding securing the binding edges of the plurality of individual tabs together as a unit, so the individual tabs can be folded back like a page of a book and an adhesive positioned on said individual tabs to hold a sheet of material thereto as the sheet of material and the tab are folded open like a book.

11 Claims, 6 Drawing Sheets

REMOVABLE BINDING SYSTEM

CROSS REFERENCE TO RELATED APPLICATIONS

This application is a continuation-in-part of my U.S. patent application Ser. No. 08/440,097; filed May 12, 1995 and titled REMOVABLE BINDING SYSTEM which is abandoned.

FIELD OF THE INVENTION

This invention relates generally to sheet-fastening devices and, more specifically, to improvements to sheet-fastening devices that allow a person to temporarily hold papers, cards, photos, x-ray film and similar sheet-like material in sequential book-like arrangements to enable access to the sheets like the pages of a book.

BACKGROUND OF THE INVENTION

A person often has individual sheets that need to be temporarily held together, yet need to be opened for review or reading. For example, a person playing an instrument might have individual sheets of music setting on a music stand. As the person finishes one sheet, he or she needs to flip the sheet to reveal the next sheet.

In other instances, a person might want to hold sheets of a speech in place as he or she reads from the speech. While cumbersome devices such as ring binders exist, being able to quickly fasten together a plurality of sheets for future use as well as the capability of substituting one sheet for another is more desirable. In addition, if a person desires to assemble sheets in book-like fashion, he or she could open the sheets and lie them flat on a surface.

The present invention provides a device for temporarily holding a plurality of sheets in a condition for full access as well as permitting binding of the sheets in a stack sequentially which he or she can then open as though it were a book or a booklet. The sheets of material fastened to the leaves of the binding system can be removed, replaced, or rearranged at will while the leafs are bound along the edges to secure the sheets in a functional relationship to permit use as an openable binder. Particular applications for sequencing sheets of material are sheet music for musicians, presentations for professionals, layouts for graphic artists, lectures for teachers, book-creation projects for school children, photo albums, x-ray, sequences in medicine, bills and receipts for accountants etc. In each of these cases, the person can position the sheets in the unit and then open the unit to read the sheets much as one would read a book.

DESCRIPTION OF THE PRIOR ART

U.S. Pat. No. 5,169,254 shows a sheet-fastening system with a metal clip holding the sheets of the fastener in a stack-like arrangement. A permanent adhesive is placed on the sheets of the fastener to permanently hold sheets of paper to the stack. The invention does not lay flat and does not permit for substitution of sheets.

U.S. Pat. No. 5,378,515 shows a corner tab with adhesively bound sheets.

U.S. Pat. No. 4,913,462 shows a folder holding record keeping sheets with adhesive strips covered by peelable protective strips.

U.S. Pat. No. 4,715,759 shows a binding that allows removal of the document.

U.S. Pat. No. 4,662,770 shows a reinforcement tape with pressure-sensitive adhesive.

U.S. Pat. No. 2,962,335 shows a filing device having pressure-sensitive adhesive.

SUMMARY OF THE INVENTION

Briefly, the invention comprises a removable binding system for temporarily holding a plurality of individual sheets in a book-like manner comprising a plurality of individual tabs, each of the tabs having a binding edge which normally lies in a vertical plane when the tabs of the binding system are laying on a horizontal surface, a separation edge, a first surface and a second surface. The individual sheets are held together by a flexible binding which secures the binding edges of the plurality of individual tabs together as a unit so the individual tabs can be folded open like a page of a book. A repositionable adhesive is positioned on the first surface of each of the individual tabs; the repositionable adhesive is sufficiently strong to hold a sheet of material thereto as the sheet of material and the tab are folded open like a book and sufficiently weak to permit removal of the sheet of material from the tab without tearing the tab by peeling the sheet of materiel away from the tab with the repositionable adhesive.

DESCRIPTION OF THE PREFERRED EMBODIMENT

Figure 1:
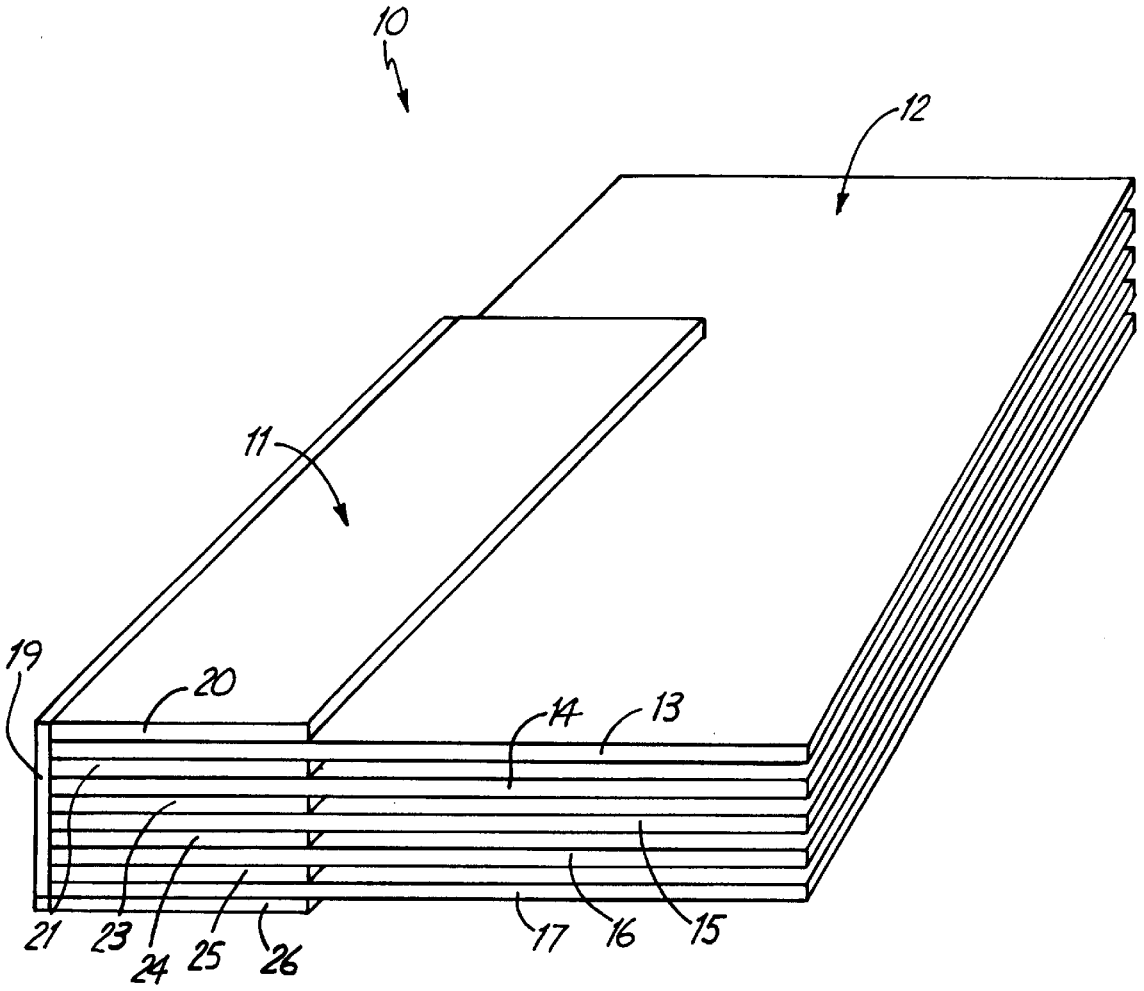
FIG. 1 is a perspective view of my invention holding a plurality of sheets of paper in a book-like manner.

FIG. 1 reference numeral 10 identifies my open-face binding system comprised of a set of tabs 20, 21, 23, 24, and 25 that are held together by a thin flexible binding 19 which extends along one edge of the set of tabs to allow the tabs to be bent apart 180 degrees. Binding 19 is typically a flexible adhesive that secures the edges of the tabs to each other in the similar manner as the pages of a book are bound together. If needed, threads can be embedded in the binding or binder reinforcement applied to the surface to provide greater strength. FIG. 1 shows that attached to tab 20 is a sheet 13, attached to tab 21 is a sheet 14, attached to tab 23 is a sheet 15, attached to tab 24 is a sheet 16, attached to tab 25 is a sheet 16 and attached to tab 25 is a sheet 17.

While the stack of tabs as shown comprises only six tabs, more or fewer tabs could be used if one needed to hold a greater or lesser number of sheets in a fold-open position. In addition, the tabs could be configured in various shapes to provide a more aesthetic appearance. Further, while a plurality of tabs are bound together with a flexible binding, if desired, one could separate some of the tabs for use with only a few sheets of material.

Figure 2:
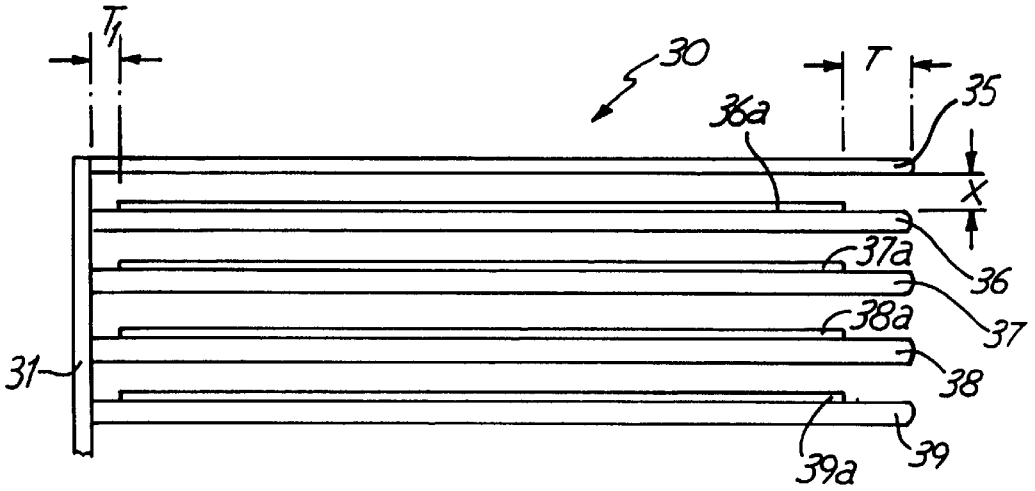
FIG. 2 is an end view of one embodiment of my invention with a layer of repositionable adhesive on one side of the foldable tabs.

FIG. 2 shows an end view of one embodiment of binding system 30 having a flexible binding 31 holding a binding edge of tabs 35, 36, 37, 38 and 39 which normally lie in a vertical plane when the tabs of the binding system are laying on a horizontal surface. Located on tab 36 is a layer of repositionable adhesive 36*a*, and similarly located on tab 37 is a repositionable adhesive 37*a*; on tab 38 is a repositionable adhesive 38*a*; and on tab 39 is a repositionable adhesive 39*a*. The layer of repositionable adhesive is positioned on one surface of each of individual tabs 36, 37, 38 and 39. The repositionable adhesive is characterized by being sufficiently strong to hold a sheet of material thereto, as the sheet of material and the tab are folded open like a book, and sufficiently weak to permit removal of the sheet of material from the tab without tearing the tab, by peeling the tab with the repositionable adhesive back from the sheet of material.

FIG. 2 also shows that the tabs are spaced apart a distance x which is about equal to the thickness of the sheet of material to be placed between individual tabs. The purpose of having spacing between the tabs is to permit the tabs to hold the sheets of material in a stacked arrangement, with the tabs remaining substantially parallel to each other and to the sheets of material. That is, if a large number of sheets were held together without spacing, the binding system would not hold the sheets flat. Thus, the present invention provides for lateral spacing of tabs from each other a distance "x" during the manufacture of the tabs which is sufficiently thick so as to temporarily accommodate material therebetween in a book-like manner. By use of spacing between the tabs one can eliminate the peelable strips.

FIG. 2 also shows an embodiment where there is an adhesive-free region having a width "y" proximate one end of the tabs and a second adhesive free region having a width "$y_1$" proximate the other edge of the tabs. The adhesive-free region proximate the free edge of the tab is to permit one to easily pull the tab away from a sheet of material therein, so the sheet of material can be replaced. The adhesive-free region proximate the binding is to prevent the adhesive from being jammed or pinched on the edge of the sheet if the sheet is slightly larger than the space between tabs. Eliminating jamming assures one that he or she can easily remove a sheet of material therein; that is, the adhesive is not forced under pressure to form a more permanent bond with the sheet of material. However, in certain applications one may choose to have the adhesive extend all the way across the tab to take advantage of the greater holding power in the squeezed areas of the tab.

Figure 3:
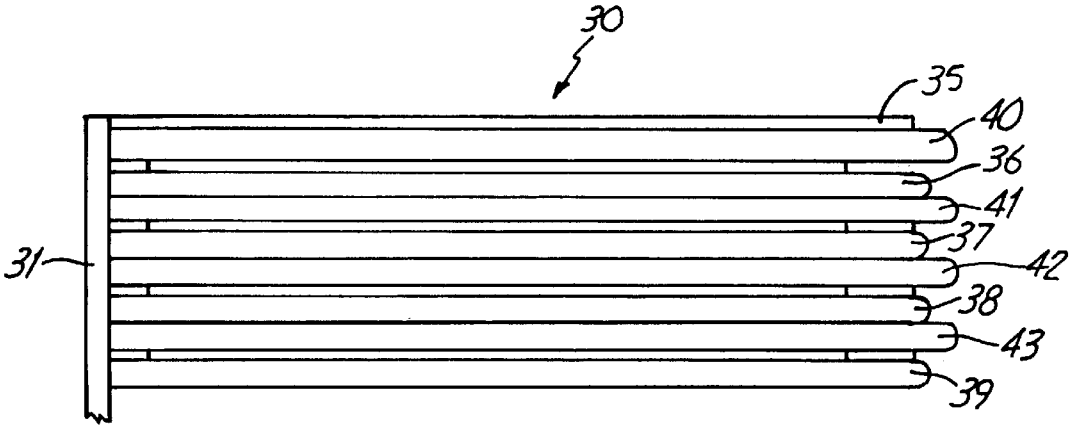
FIG. 3 shows an end view of the invention of FIG. 2 with peelable strips located over the adhesive on the tabs.

FIG. 3 shows an end view of the binding system of FIG. 2 with release liners 40, 41,42 and 43 located therein to cover the repositionable adhesive before the binding system is used. That is, the release liner can be easily stripped from the repositionable adhesives as needed to expose the adhesive and enable fastening of a sheet of material thereto. As an alternate embodiment one could place a release material on the opposite side of the tab and thus eliminate the need for a release liner.

In order to minimize paper cuts when inserting or removing sheets of material from the binding system one can place a coating of material over the exposed edge of the tab. A suitable material is a latex rubber which is flexible and covers the sharp edge of the tab. This coating would also provide a gripable surface to aid finger grip in opening tab.

Figure 4:
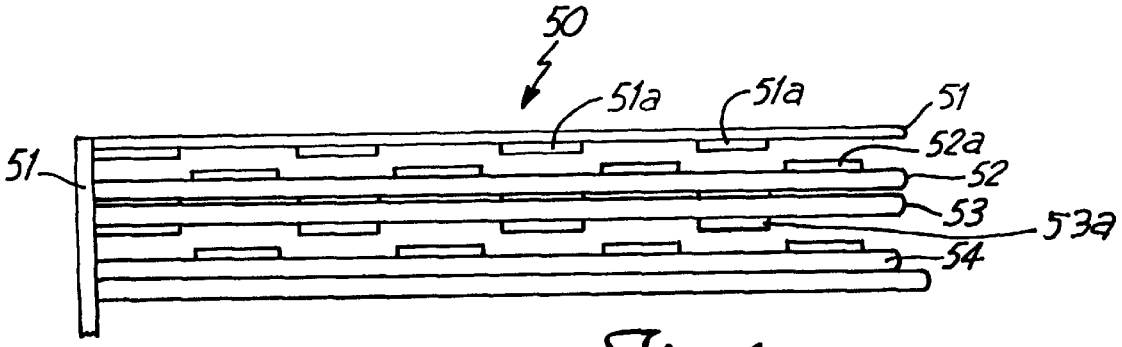
FIG. 4 shows an alternate embodiment showing a sheet fastener that has tabs for attaching to opposite sides of a sheet.

FIG. 4 shows an alternate embodiment of the invention with a flexible binding 51 and tabs having a binding edge secured to flexible binding 51. The embodiment of FIG. 4 shows that two tabs are used to sandwich and hold a sheet of material therebetween. An upper tab 51 has a plurality of strips 51*a* of repositionable adhesive located thereon with the companion lower tab 52 having a further plurality of repositionable adhesive strips 52*a* alternately spaced from the upper strips so that the tabs can be secured to each other and released from each other without the aid of a release liner. Similarly, a further tab 53 has a plurality of strips of repositionable adhesive 53*a* located thereon, with the companion lower tab 54 having a further plurality of repositionable adhesive strips 54*a* alternately spaced from the upper strips 53*a* so that the tabs can be secured to each other without the aid of a release liner. As an alternate embodiment, opposing surface to removable adhesive could be coated with release material.

Figure 5:
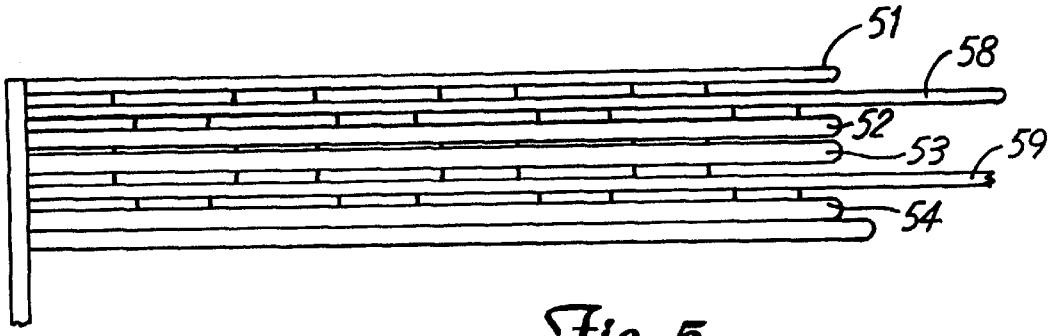
FIG. 5 shows the embodiment of FIG. 4 with sheets temporarily secured thereto.

FIG. 5 shows tab 51 and 52 sandwiching a sheet of material 58 therebetween and tabs 53 and 54 sandwiching a sheet of material 59 therebetween.

Figure 6:
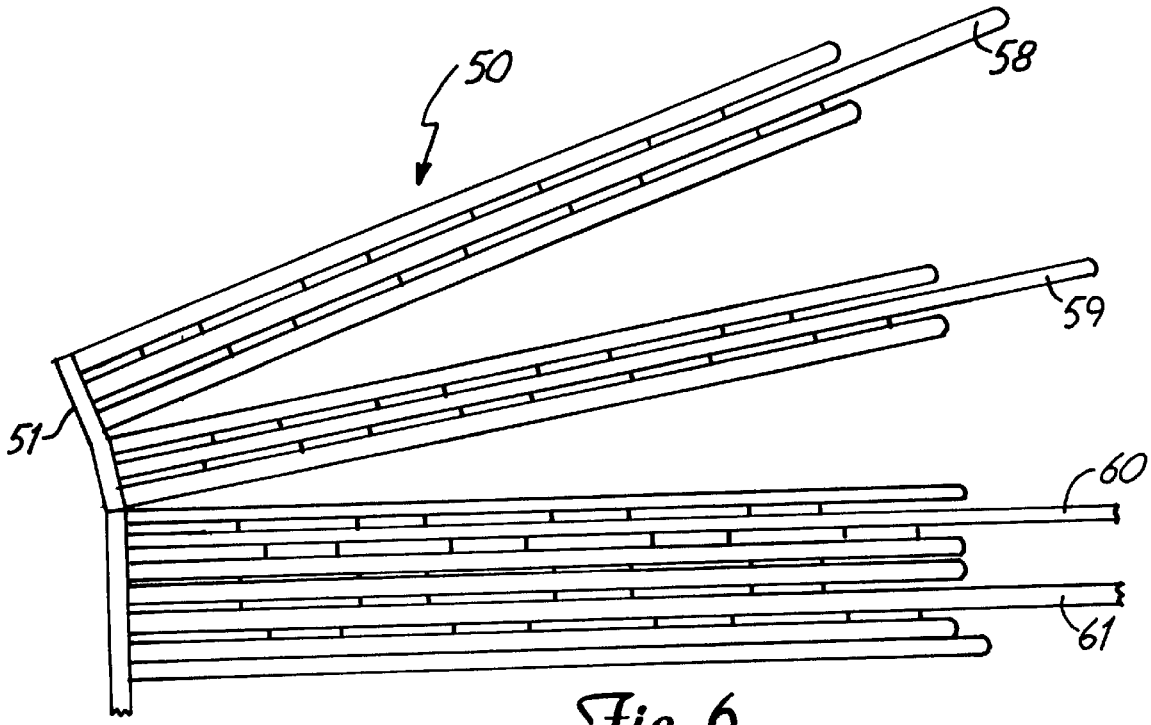
FIG. 6 shows the embodiment of FIG. 5 as the sheets are folded open.

FIG. 6 shows reference binding system 50 with more tabs for holding additional sheets of material. One of the features of the present invention is that, as few as two sheets can be held in a foldable relationship and more than two sheets can be held in a foldable relationship by merely having additional tabs with repositionable adhesives thereon. FIG. 6 shows sheets 58, 59, 60 and 61 held between adjacent leaves by the repositionable adhesive located on the tabs. FIG. 6 further illustrates that, because of the flexible binding 51, the identical sheets 58 and 59 can be opened and laid back as one would lay back the pages of a book.

Figure 7:
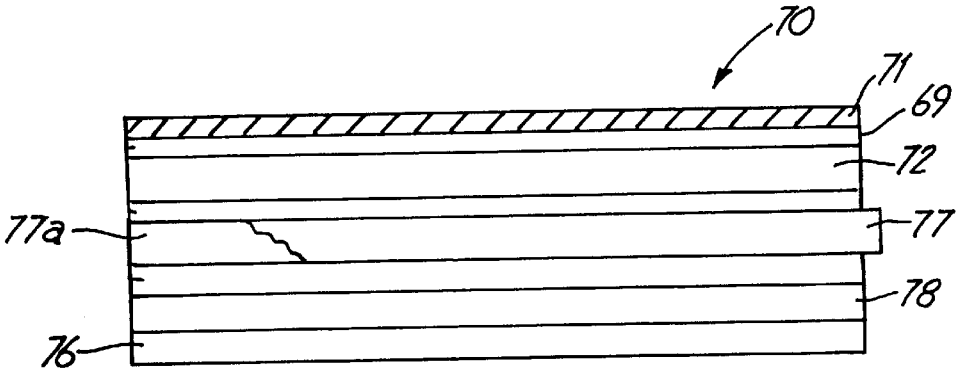
FIG. 7 shows an alternate embodiment having two different adhesives thereon.

FIG. 7 shows a further alternate embodiment of the invention with numeral 70 designating the binding system. Binding system 70 includes a flexible binding 71 secured to one edge of tab 69. Tab 69 includes an adhesive-free region which extends a width of approximately 1/16 to 1/8 of an inch along the length of binding 71. The purpose of the adhesive-free space adjacent to the binding is to simplify removal and replacement of sheets because it has been found that extending the adhesive to the edge of the binding can cause jamming and hinder removal of a sheet of material from the tab. However in certain applications the additional holding with no adhesive free space can be desirable.

Tab 69 includes two different adhesives to enable a user to temporary or permanently mount a sheet of material therein. For temporarily holding a sheet of material therein, a first strip 72 of repositionable adhesive and a second strip 78 of repositionable adhesive are provided. If one needs to temporarily hold an article in place, he or she can use the repositionable adhesive strips 72 and 78. Tab 69 also includes a second adhesive strip 77*a* having a removable protective covering. Adhesive strip 77*a* is a permanent type of adhesive. That is, removing the protective covering 77 exposes the permanent adhesive which can than be contacted to a sheet of material to permanently hold the sheet of material on tab 69. Tab 69 also includes an outer edge 76 which is free of adhesive to enable one to more easily peel back tab 69 if the tab system is used with only the repositionable adhesives.

Figure 8:
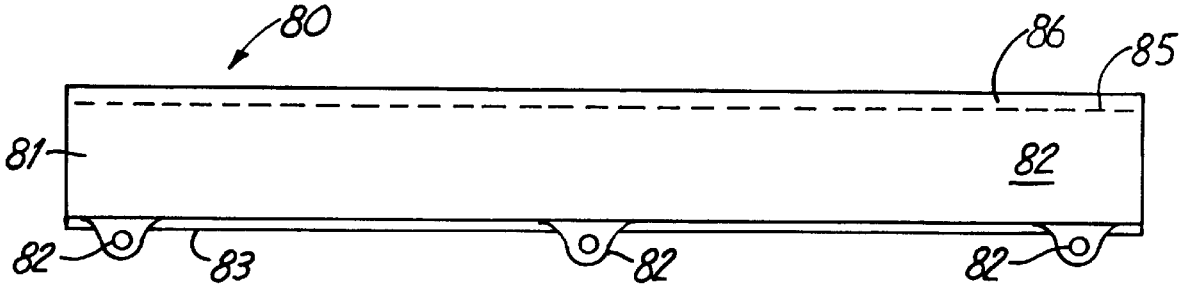
FIG. 8 shows an alternate embodiment of the invention for use with three ring binders.

FIG. 8 shows an alternate embodiment, one could secure individual tabs to a ring binder by providing holes in the tab for securing to the ring binder. Binder strip 80 comprises a strip 81 with a reposition adhesive 82 located thereon which extends up to the line 85. The region 86 above line 85 is free of adhesive to provide for ease in grasping and removing the tab. Located along one edge is a set of binder loops 82 for attachment to a three ring binder.

Figure 9:
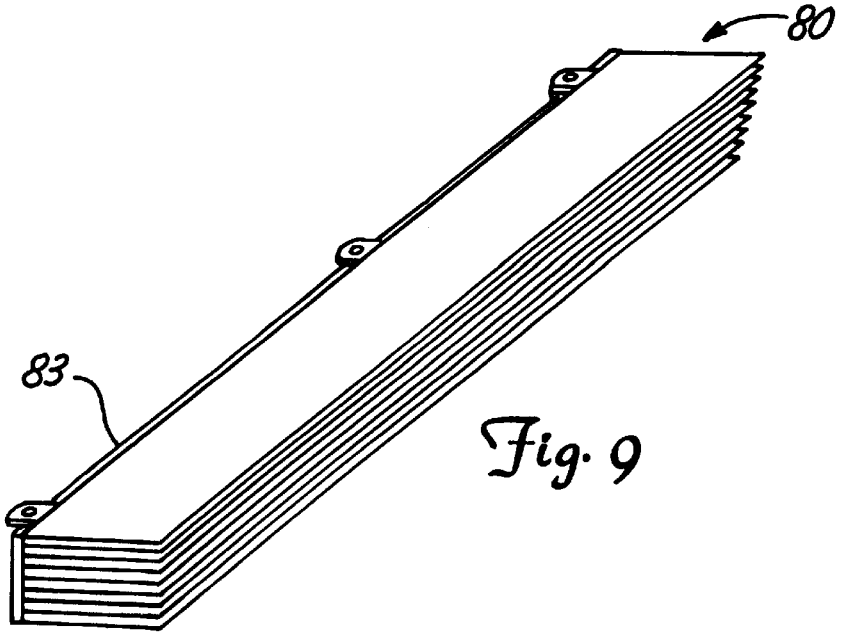
FIG. 9 shows a perspective view of the embodiment in a ready to use stack.

FIG. 9 shows a stack of binder strips with a flexible but separately binding thereon. Binding 83 can be made of an adhesive or the like. As the person needs a single binder sheet of multiple binder sheets can be separated by cutting or tearing and than remove the single or the group of sheets from the stack of binder strips. This type of unit provides for temporary storage of sheets without having to punch holes in the stored sheets, which is important for documents that need to be kept intact.

Figure 10:
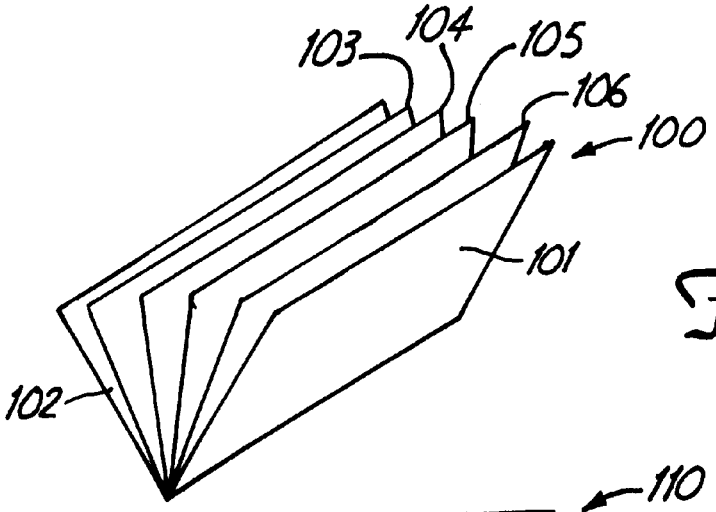
FIG. 10 shows a perspective view of a multiple page document.

FIG. 10 shows a multiple page document or booklet 100 having a front cover 102 and a rear cover 101. Located between covers 101 and 102 are a set of individual sheets 103, 104, 105, and 106 which are fastened between covers 101 and 102 to form a booklet. Typical of such material is sheet music or the like.

Figure 11:
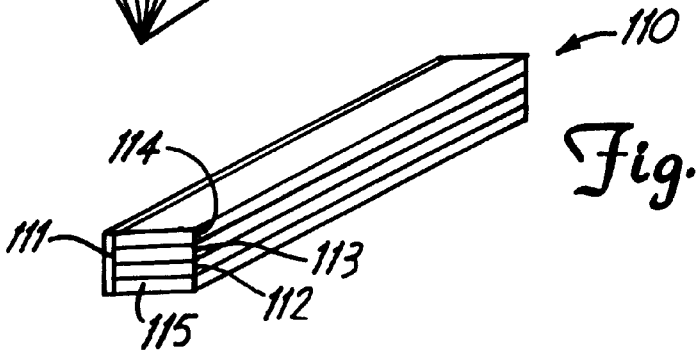
FIG. 11 is a perspective view of a holder.

FIG. 11 shows a perspective view of my binder 110 having repositionable adhesive located on each side of strip 112 and 113 and on the inside face of tab 114 and 115. A flexible binding 111 extends along the edge of binder 110 to allow the binder 110 to be laid in a flat open condition. Binder 110 can be of the type shown in FIG. 3 to FIG. 6 wherein the faces of opposing tabs of the binder include a repositionable adhesive so that the two tabs can grab a single sheet or a cover of a booklet. By use of the repositionable adhesive on two faces of a tab one can increase the holding power on the booklet. That is, the nature of repositionable adhesive is such that they release their adhesion to prevent tearing of the paper. In the present invention the repositionable adhesive on the opposite faces coact to provide stability to the booklet to prevent the booklet from accidentally being removed from the binder as the pages are turned.

Figure 12:
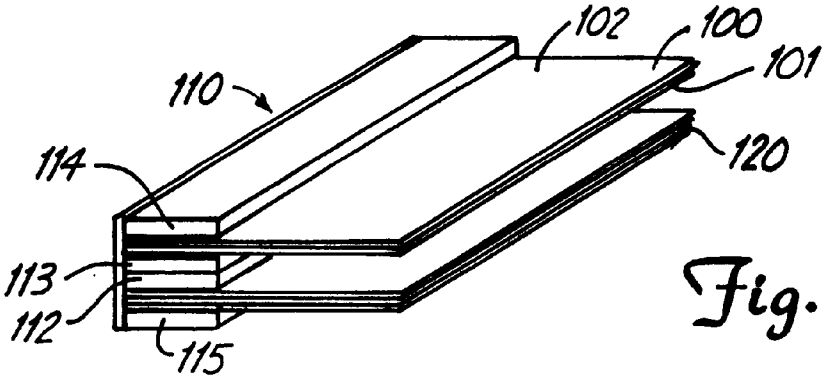
FIG. 12 is a perspective view of the holder of FIG. 10 and the multiple page document of FIG. 10.

FIG. 12 shows binder 1 holding first multiple page booklet 100 and a second multiple page booklet 120. The repositionable adhesive on the inside face of binder strip 114 holds cover 102 and the repositionable adhesive on one side of binder strip 113 holds cover 101. Similarly, the repositionable adhesive on the opposite side of binder strip 112 holds one cover of booklet 120 while the repositionable adhesive on one side of binder strip 115 holds the opposite cover of booklet 120.

Figure 13:
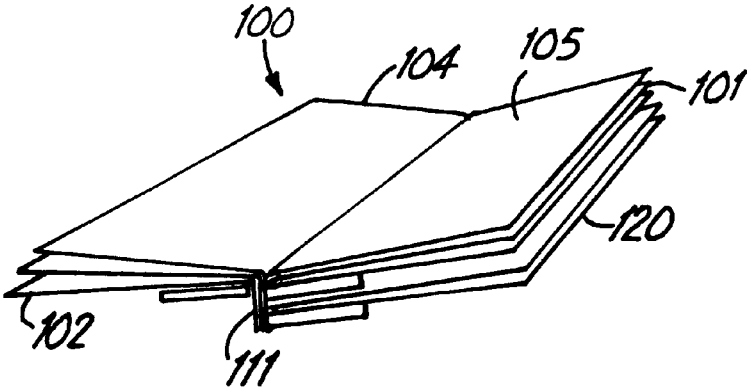
FIG. 13 shows the holder maintaining a multiple page document in a flat condition.

FIG. 13 shows that binder 110 can hold the booklet 100 in an open or flat condition while allowing the individual pages 103, 104, 105 and 106 to be turned readily. FIG. 13 also shows binding edge 11 in a vertical plane when tab binder system 10 is laying on a horizontal surface. In the present embodiment the intersection of the upper and lower tabs forms a bending line for the binding system.

It will be appreciated that the repositionable adhesive on my binder allows one to quickly replace entire booklets in the binder. That is, if two different booklets are required for an event and for a subsequent event one booklet needs to be changed the person can easily remove one booklet and replace it with another booklet. When the replacement is completed the binder allows the booklet to be laid flat for easy reading.

I claim:

1. A removable binding system for temporarily holding a plurality of individual sheets or a booklet in a book-like manner comprising:

a plurality of individual tabs, each of said tabs having a binding edge, a separation edge, a first surface and a second surface with said binding edges of said tabs located in alignment with one another, each of said tabs spaced from each other a distance so as to temporarily accommodate material therebetween in a book-like manner;

a flexible binding, said binding securing said binding edges of each of said plurality of individual tabs stacked together in a spaced apart relationship to provide space for a stack of material between adjacent tabs to accommodate the thickness of the booklet therebetween without substantially distorting the binding system and still permitting the individual tabs to be folded flat like a page of a book;

a first repositionable adhesive positioned on a first surface of each of one of said individual tabs, said repositionable adhesive sufficiently strong to hold a booklet thereto as the booklet and the tab are folded open and sufficiently weak to permit removal of the booklet from the tab without tearing the tab by peeling the tab with the repositionable adhesive back away from the booklet;

a second repositionable adhesive positioned on a second surface of another of said individual tabs, said second repositionable adhesive sufficiently strong to hold a booklet thereto as the booklet and the tab are folded open and sufficiently weak to permit removal of the booklet from the tab without tearing the tab by peeling the tab with the repositionable adhesive back away from the sheet of material, said first repositionable adhesive and said second repositionable adhesive facing toward each other and coacting to hold said booklet in position to thereby inhibit the booklet from being accidentally being removed from the tabs as the sheets of the booklet are turned; and an adhesive free region on said first surface of each of said individual tabs, said adhesive free region located proximate and extending along said binding edge to prevent jamming of the adhesive on the sheet of material located between adjacent individual tabs to thereby facilitate removal of the sheet of material from the tab.

2. The removable binding system of claim 1 wherein the individual tabs have repositionable adhesive on both the first surface and the second surface with said repositionable adhesive on said first surface of said individual tabs is spaced across from a region free of said repositionable adhesive on an adjacent tab and said repositionable adhesive on said second surface of said adjacent tab is space spaced across from a region free of repositionable adhesive on said first surface to enable the tabs to be separated therefrom for securing a sheet of material to each of said first surfaces and said second surfaces.

3. The removable binding system of claim 2 wherein individual tabs located adjacent to one another have alternate bands of repositionable adhesive for ease in separating the adjacent tabs.

4. The removable binding system of claim 3 wherein two tabs secure a sheet therebetween.

5. The removable binding system of claim 4 wherein the repositionable adhesive extends over a portion of said first surface to provide a gripping edge on said tab for ease in removal of the sheet of material therebetween.

6. The removable binding system of claim 5 including at least four tabs with adhesive thereon.

7. A binding system for holding a plurality of individual sheets in a book-like manner comprising:

a first plurality of individual tabs spaced from each other to accommodate a sheet of material therebetween, each of said tabs having a binding edge connecting the individual tabs together, a separation edge, a first surface and a second surface, each of said individual tabs spaced from each other a distance to simulate the width of a page to be fastened therein to permit the tabs to hold the page in a book-like condition;

a member for holding said binding edges of said plurality of individual tabs together as a unit so the individual tabs can be folded back like a page of a book;

a first repostionable adhesive positioned on said first surface of each of said individual tabs, said adhesive sufficiently strong to hold a sheet of material thereto as the sheet of material and the tab are folded open like a book to enable the binding system to expose sheets of material secured thereto, said first adhesive sufficiently weak to permit removal of the sheet of material from the tab without tearing the tab by peeling the tab with the repositionable adhesive back away from the sheet of material; and a second plurality of individual tabs, said second set of tabs coacting with said first set of tabs to hold a sheet of material in position to thereby inhibit the sheet of material from being accidentally being removed therefrom.

8. The binding system of claim 7 including a second adhesive on a first surface of a second tab with the second adhesive sufficiently strong to hold a sheet of material thereto as the sheet of material and the tab are folded open like a book and sufficiently weak to permit removal of the sheet of material from the tab without tearing the tab by peeling the tab with the repositionable adhesive back away from the sheet of material.

9. The binding system of claim 8 wherein a removable strip is removed to enable securing a sheet of material to both said first adhesive and said second adhesive to securely hold said sheet of material in position as the binding system is opened or closed.

10. The binding system of claim 7 including loop members for attachment to a ring binder.

11. The binding system of claim 10 including flexible adhesive to make the binding system separable.

* * * * *